US005396912A

United States Patent [19]

Chou

[11] Patent Number: 5,396,912

[45] Date of Patent: Mar. 14, 1995

[54] STRUCTURE OF BARRETTE

[76] Inventor: Kuo H. Chou, Suite 1, 11F, No. 95-8 Chang Ping Road. Sec. 1, Taichung, Taiwan, Prov. of China

[21] Appl. No.: 159,289

[22] Filed: Nov. 30, 1993

[51] Int. Cl.[6] ..... A45D 8/22

[52] U.S. Cl. ..... 132/279; 132/278

[58] Field of Search ..... 132/278, 279

[56] References Cited

U.S. PATENT DOCUMENTS

| | | | |
|---|---|---|---|
| 2,403,601 | 7/1946 | Jackson | 132/278 |
| 2,699,789 | 1/1955 | Goodman | 132/278 |
| 2,778,367 | 1/1957 | Gresham et al. | 132/279 |
| 2,818,871 | 1/1958 | Beaudry | 132/278 |
| 2,998,015 | 8/1961 | Gresham et al. | 132/279 |
| 3,412,739 | 11/1968 | Thatcher | 132/278 |
| 5,109,878 | 5/1992 | Kuo-Hua | 132/278 |
| 5,284,167 | 2/1994 | Gill | 132/278 |

*Primary Examiner*—Gene Mancene

*Assistant Examiner*—Frank A. LaViola

[57] ABSTRACT

A barrette for clipping hair comprises a first and a second arcuate elongate members pivoting on corresponding end portions thereof. The first member has at one end, a pair of laterally formed first hinge rings, the other end a roughly rectangular lock having an off-center receiving space with a pair of superposed catchs therein and three rows of the pyramid shaped projections on the inward periphery extending along longitudinal direction. The second member has at one end a single hinge ring, the other end a rectangular hasp and a two, oppositely formed "S" shapes which are connected at one end to form a closed elongate elastic plate extended downwards from the under side forming a multiple elastic region thereinbetween. This disclosure has been characterized in a stepped locking means and a multiple elastic region that provide selective engagement enabling the barrette serving for different hair bundles in varied styles.

4 Claims, 10 Drawing Sheets

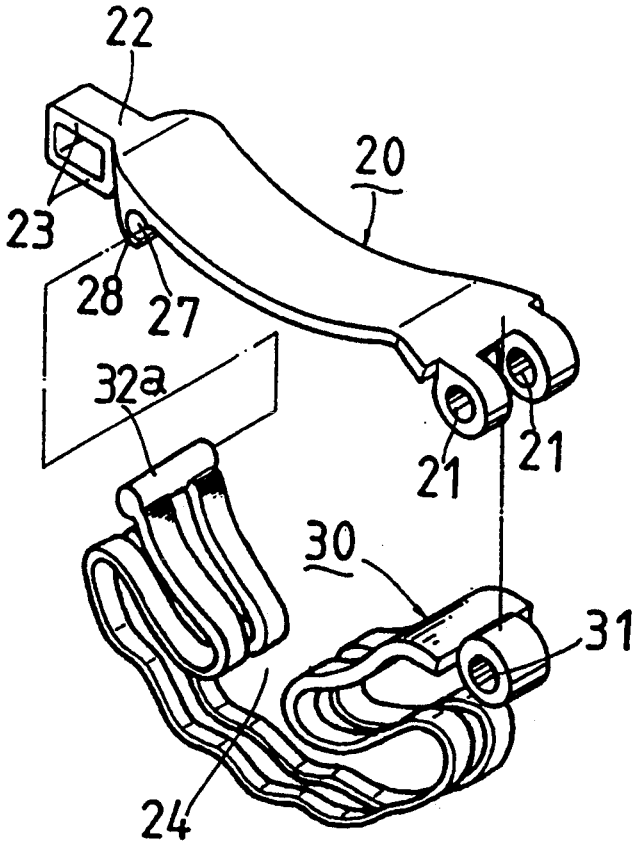
FIG. 17
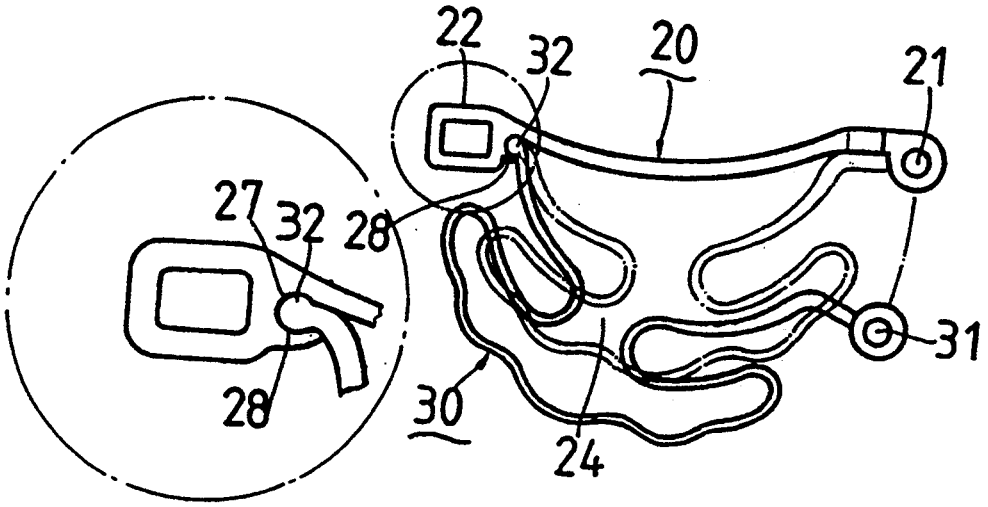
FIG. 18A
FIG. 18

STRUCTURE OF BARRETTE

BACKGROUND OF THE INVENTION

The present invention relates to hair clipping articles, more particularly to a barrette for clipping hair having multiple elastic clipping regions defined therein incorporated a stepped locking means formed therewith enables a selective and waved clipping for different style of hair bundle therein. The stepped locking means provides more than one catch means therein having inclinedly arcuate surface thereon that facilitates a sliding engagement with corresponding hasp by an eccentric movement and their material elasticity.

Prior art hair clips are known most likely composed of a pair of slightly arcuate first and second elongate sheet metals pivotally attached on their corresponding ends and releasably engaged on the other ends, in addition to an inversely arcuate elastic means which is secured on two ends to the inward surface of the first sheet metal thereon and in alignment with an elongate slot along the longitudinal center line of the second sheet metal. When clipping, the first and second sheet matels are releasable engaged so as to force the inversely arcuate elastic means protruding out of the elongate slot on the second sheet metal in order to effectively fasten a fair bundle thereinbetween.

However, this structure causes shearing stress during a momentary disengagement that breaks up the fine hair. On the other hand, it is unable to serve for thick hair due to it's simple structure and poor capability that could not embody maximum efficiency.

SUMMARY OF THE INVENTION

The primary object of the present invention is to provide a barrette structure having a multiple elastic clipping regions therein incorporated with a stepped locking means thereof that suits to different geometrical engagement in order to selectively and wavedly clip the different hair bundles thereinbetween.

Another object of the present invention is to provide a barrette structure comprising a multi-layer superposed catchs formed in a locking means thereof having inclinedly arcuate surface that facilitates a sliding and flexible engagement.

Accordingly, the present invention of a barrette structure comprises an arcuate elongate first member and an arcuate elongate second member having at their one ends thereof pivotally connected, the other ends being releasably engageable to each other.

The first member has greater curvature comprising a pair of laterally formed first hinge rings thereof at one end, a rectangular locking means thereof at the other end and three rows of pyramid shaped projections parallel formed on the inward surface along its longitudinal axis. The locking means comprises an off-center rectangular receiving space including a pair of superposed catch means therein perpendicular to the inward surface of a vertical wall and extended parallel to a limited distance. The catch means have their arcuate upper surface and inclinedly tapered off ends.

The second member having a lesser curvature than the first member comprises a second hinge ring thereof centrally formed at one end, a folded over rectangular hasp thereof at the other end and a two, opposite formed "S" shapes which are connected at one end to form a closed elongate elastic plate thereof extended at the two ends therefrom defining a multiple elastic regions therein. The elastic plate has an elongate slot centrally formed along its longitudinal center line and two rows of smaller pyramid shaped projections thereof formed along its multi-waved bottom portion.

The two members are pivotally hinged at their corresponding ends by a retaining pin and the other ends being releasably engageable upon an eccentric movement and the material elasticity of the second member.

In one embodiment there are three longitudinal elongate projections provided instead of the three rows of the pyramid shaped projections thereof on the inward surface of the first member and a single catch means provided instead of the pair of superposed catch means thereof in the locking means. In another embodiment, a separate second member is provided. In a further embodiment, there is another engagement device provided to the second member.

The present invention will be more fully understood by reference to the following detailed descriptions thereof when read in accompanying with the attached drawings.

BRIEF DESCRIPTION OF THE DRAWINGS

FIG. 17 is an exploded perspective view showing a separate structure of a second member in accordance with a third embodiment of the present invention, FIG. 18 and 18A are the side views showing an elastic elongate plate being releasable with a base of a second member in accordance with the third embodiment of the present invention.

DETAIL DESCRIPTION OF THE PREFERRED EMBODIMENT OF THE PRESENT INVENTION

Figure 1:
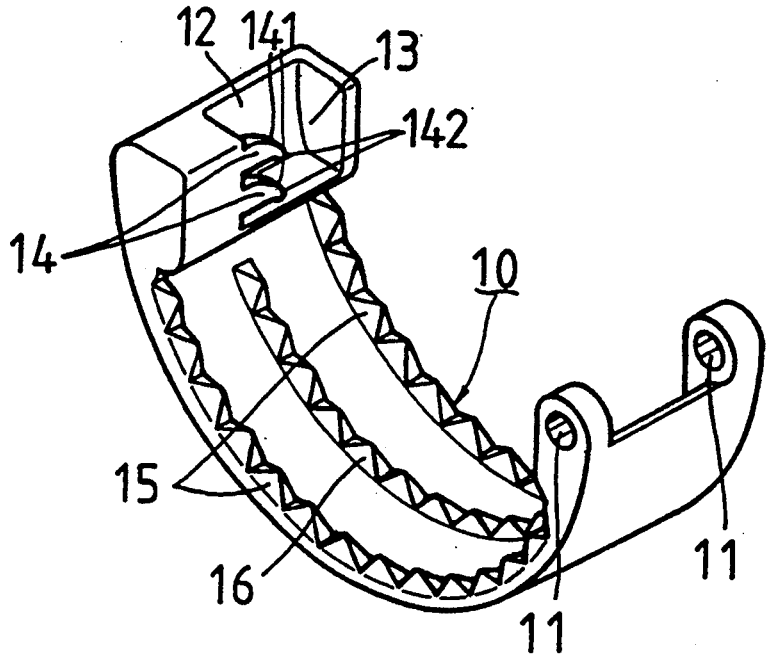
FIG. 1 is a perspective view showing a first member of a barrette in accordance with the first embodiment of the present invention.
Figure 2:
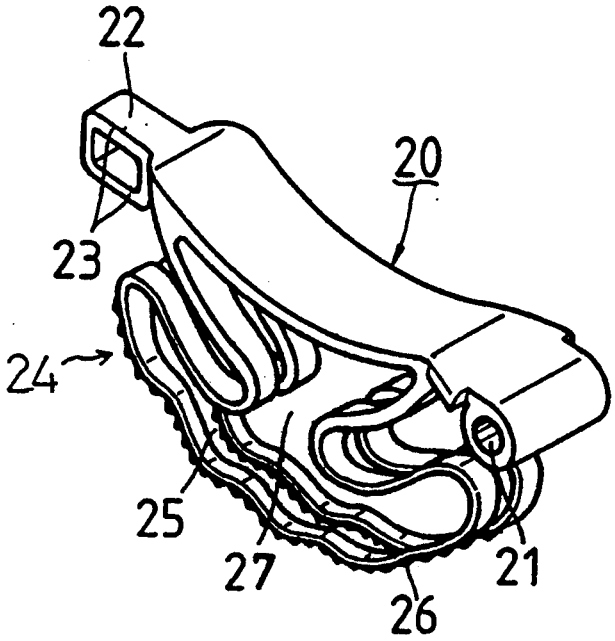
FIG. 2 is a perspective view showing a second member of a barrette in accordance with the first embodiment of the present invention.

With reference to FIGS. 1 and 2, a first embodiment of the barrette structure of the present invention comprises an arcuate elongate first member 10 in greater curvature and an arcuate elongate second member 20 in smaller curvature pivotally connected on corresponding end portions thereof.

The arcuate elongate first member 10 has at one end, a pair of laterally formed first hinge rings 11, the other end, a locking means 12 and three rows of pyramid shaped projections 15 and 16 parallel extended on inward periphery thereof along longitudinal axis.

The locking means 12 comprises a generally rectangular body having an off-center rectangular receiving space 13 therein abutting one of its lateral walls and a pair of superposed catch means 14 thereof perpendicular to an inner wall and parallel extended therefrom. The catch means have a arcuate upper surface 141 and a slightly inclined tapered end 142 thereof terminated at a limited position to allow a flexible space 13 for the passage of a hasp 22 of the second member 20.

The arcuate elongate second member 20 has at one end a second hinge ring 21 which width equals to the distance between the pair of the first hinge rings 11 of the, first member 10, the other end a folded over rectangular hasp 22 biased to the longitudinal center line and a two oppositely formed "S" shapes which are connected at one end to form a closed elongate elastic plate 24 extended downwards from two ends of the second member 20. The rectangular hasp 22 has a hollow rectangular interior and a pair of lateral openings thereof defining a pair of superposed rectangular check plate 23 which have an inclinedly arched upper surface 231 and a partially arcuate under sides 232 (see FIG. 10). The elongate elastic plate 24 which has a gradual thickness comprises an elongate slot 25 centrally extended along the longitudinal axis thereof and two rows of smaller pyramid shaped projections 26 parallel formed along a waved bottom portion thereon, so as to define a multiple elastic region 27 thereinbetween for flexibly fastening different hair bundles.

Figure 3:
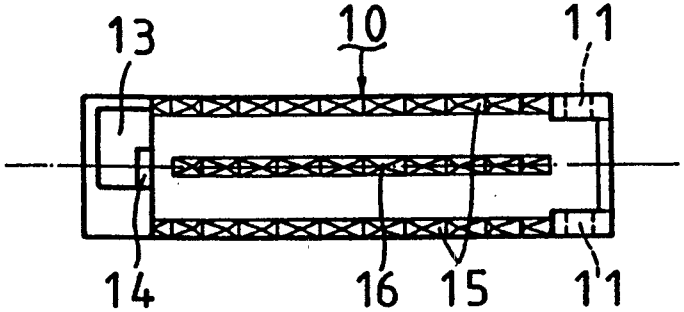
FIG. 3 is a top view showing a first member of a barrette in accordance with the first embodiment.
Figure 4:
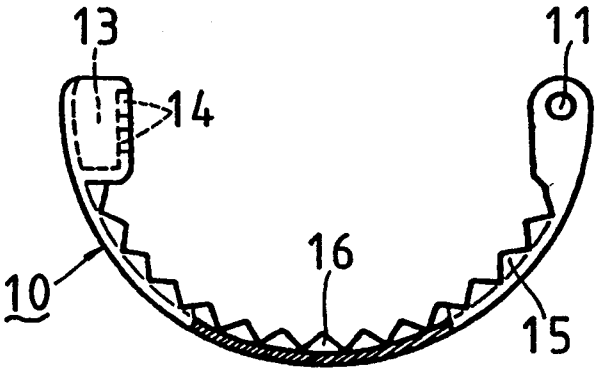
FIG. 4 is a side view of FIG. 3.

With reference to FIG. 3 of a top view which shows a relative position of the off-center rectangular receiving space 13 and the superposed catch means 14 at one end of the first member 10 of a barrette. Where FIG. 4 shows their vertical positions respectively.

Figure 5:
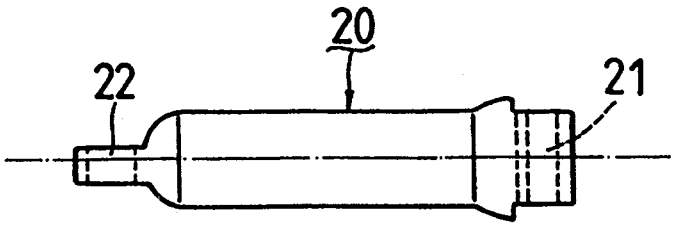
FIG. 5 is a top view showing a second member in accordance with the first embodiment.
Figure 6:
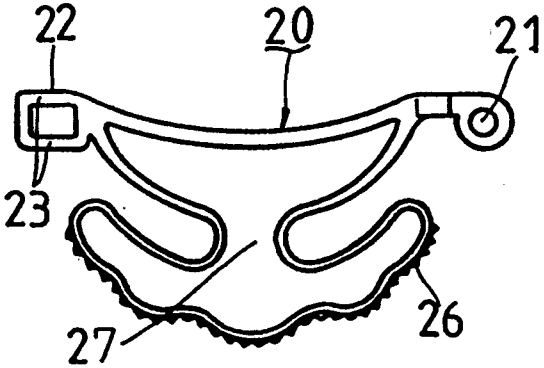
FIG. 6 is a side view of FIG. 5.

Referring to FIGS. 5 and 6 of a top view and a side view of the second member of a barrette in accordance with the first embodiment apparently shows the rectangular hasp 22 being biased to a lateral side relative to the longitudinal center line of the second member 20.

Figure 7:
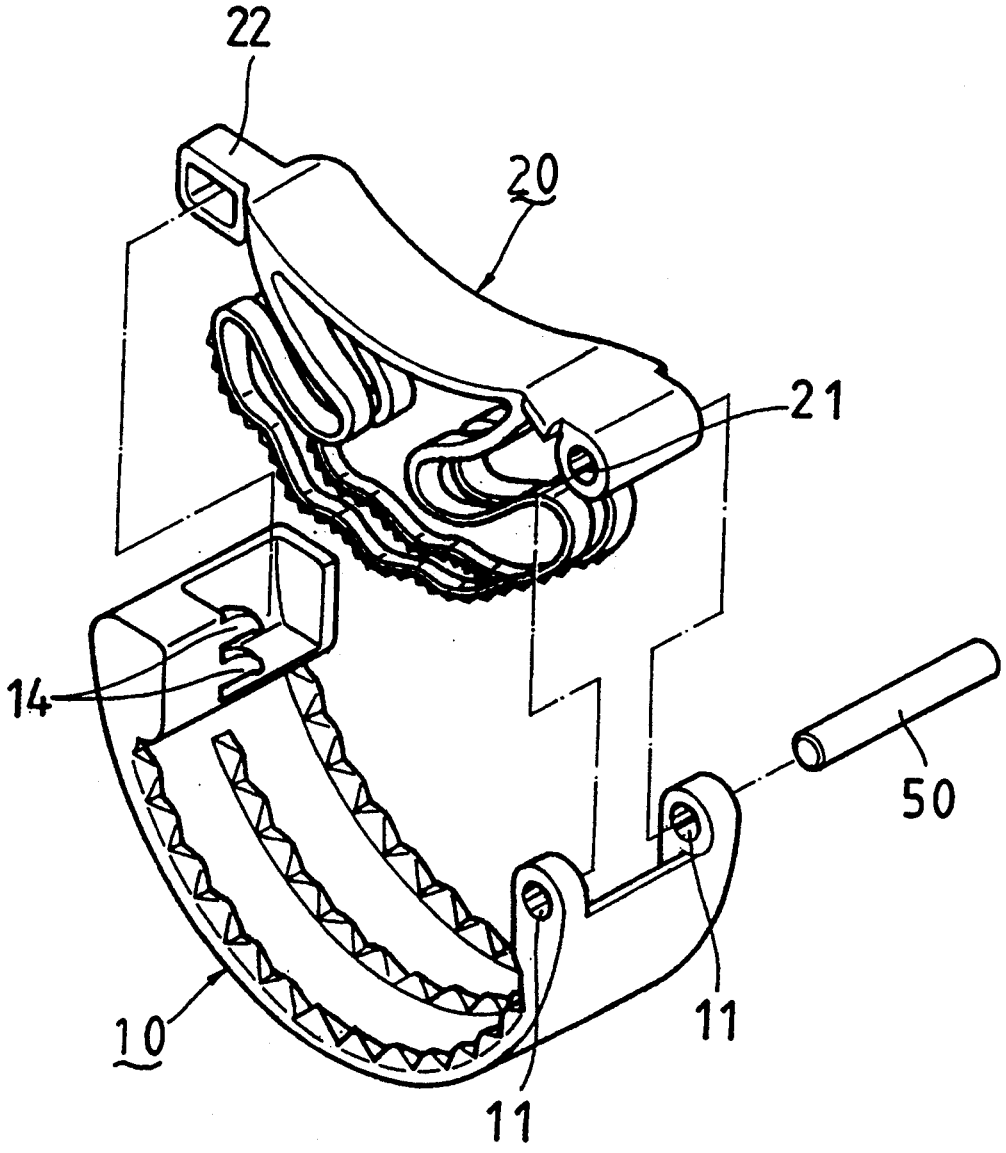
FIG. 7 is perspective view showing an assembled structure of a first and a second member in accordance with the first embodiment.
Figure 8:
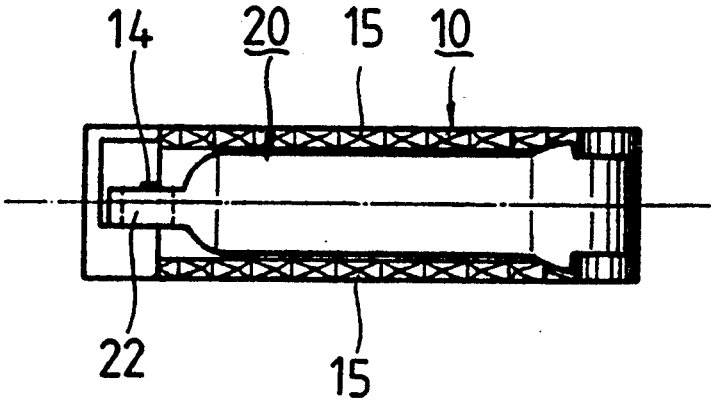
FIG. 8 is a top view of FIG. 7.
Figure 9:
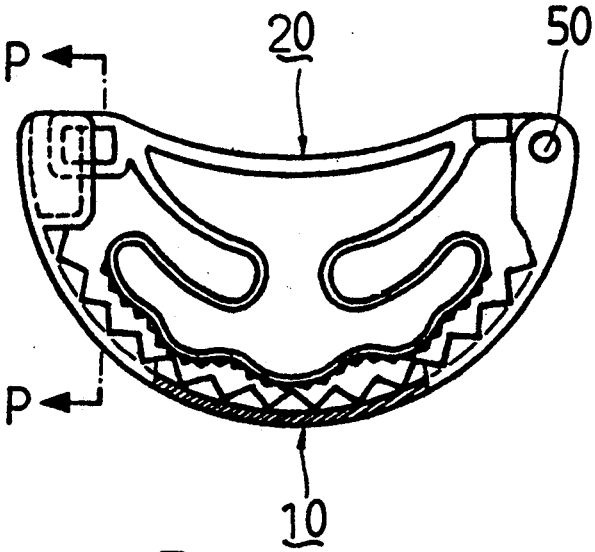
FIG. 9 is a side view of FIG. 7.

Referring to FIG. 7 of a perspective view showing a barrette structure according to the first embodiment when assembling, the second hinge ring 21 of the second member 20 is to align with the pair of the first hinge rings 11 of the first member 10 and pivotally secured by a retaining pin 50 therein. Where, the rectangular hasp 22 on the second member 20 thereof slides to the receiving space and is releasably locked by the pair of the superposed catch means 14 of the first member 10 therein. FIGS. 8 and 9 show an assembled structure of a barrette in accordance with the first embodiment of the present invention.

Figure 10:
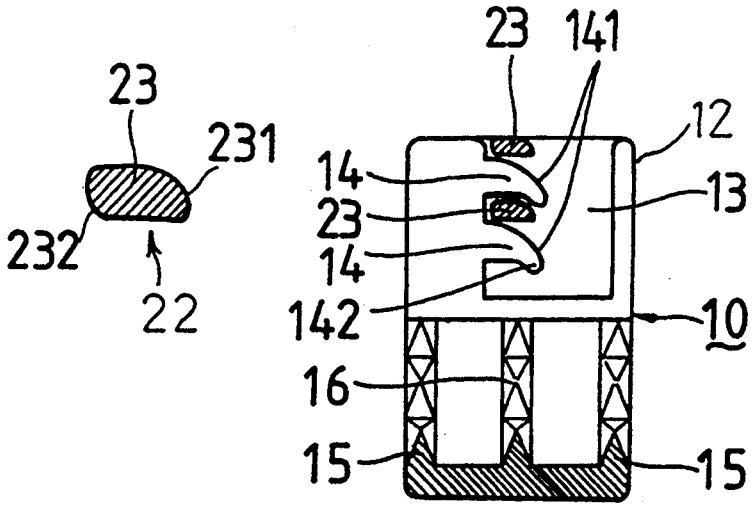
FIG. 10 is a sectional view showing a locking means in accordance with the first embodiment, along P—P part of FIG. 9.

FIG. 10 provides a detailed description of the locking means 12 being in function with the hasp 22. When the check plate 23 of the second member 20 is pressed to contact with the inclinedly arcuate upper surface of the catch means 14, it slides downwards into the flexible space 13 because of it's partially arcuate under side and then resile back to releasably engage with the under side of the catch means 14 therein upon the material elasticity of its own and an offsetting reaction. Press on the second member 20 another time, the check plate 23 of the hasp 22 releasably slides into the flexible space 13 again and then jumps up to disengage with the locking means 12 upon a resilient force of the second member 20.

Figure 11:
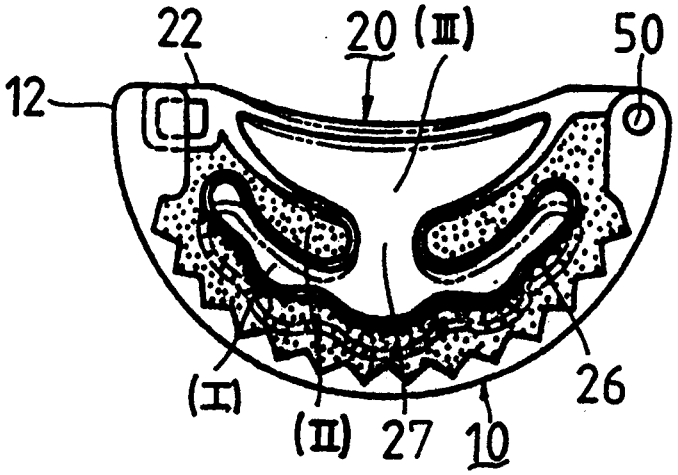
FIG. 11 is a side view showing a first embodiment of the present invention, being fastened with a hair bundle therein.

FIG. 11 shows a gripping function of a barrette in accordance with the first embodiment of the present invention. Because of that the thickness of the roughly figure "8" shaped elongate elastic plate 24 is gradually changed from the bottom to its upper portion and the upper portion is thicker than the bottom portion, the elasticity in the multiple elastic region is varied. When a hair bundle is fastened therein, region I occurs greatest elastic deformation so as to cause a biggest upward movement, region II occurs a smaller deformation so as to cause a smaller upward movement. However, region II occurs smallest deformation and causes a moderate upward movement as well. This structure insures that the elongate elastic plate 24 will not be structurally distorted. Besides, the two rows of projections 26 under it's bottom portion provide a stable gripping to the hair bundle thereinbetween.

Furthermore, the elongate elastic plate 24 provides adequate upward resilient force to both ends of the second member 20 so as to prevent the rectangular hasp 22 engaged within the locking means 12 therein from a wobbling or an inadvertent disengagement.

Figure 12:
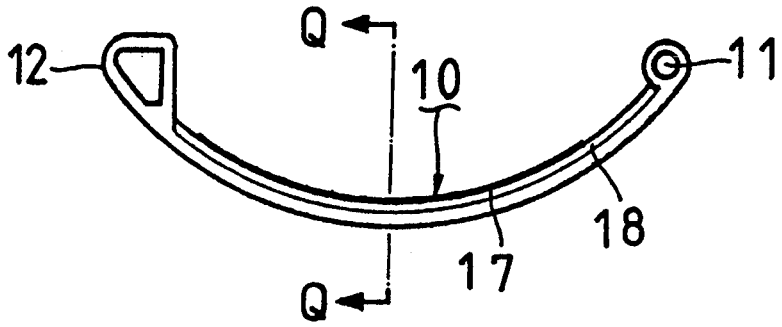
FIG. 12 is a side view showing a first member of a barrette in accordance with a second embodiment of the present invention.
Figure 13:
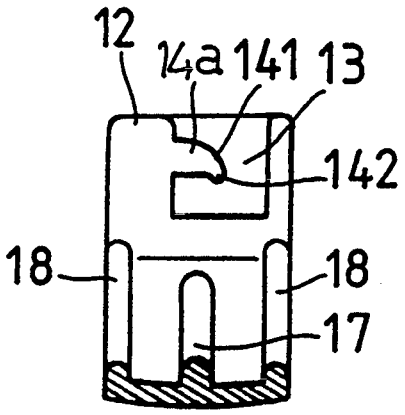
FIG. 13 is a sectional view showing a locking means and the elongate projection of a first member in accordance with the second embodiment of the present invention, along a Q—Q part.
Figure 14:
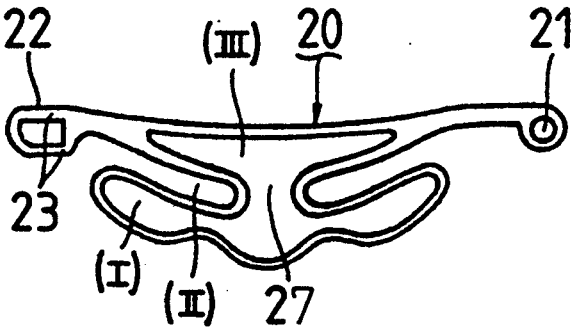
FIG. 14 is a side view showing a second member of a barrette in accordance with a second embodiment of the present invention.

With reference to FIGS. 12 and 13 show a second embodiment of a barrette structure of the present invention, wherein the curvature of the first member 10 becomes smaller than that in the first embodiment, three rows of elongate protrudent flanges 17 and 18 instead of the three rows of the pyramid projections 15 and 16 thereof parallel formed on the inward surface of the first member 10 along its longitudinal axis and a single catch means **14*a* instead of the pair of superposed catch means 14 disposed to the locking means 12 therein. However, the second member 20 (see FIG. 14**) is structurally unchanged as it is in the first embodiment.

Figure 15:
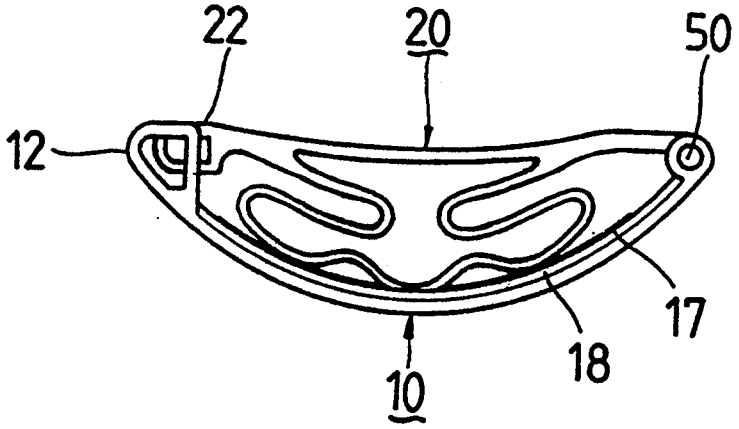
FIG. 15 is a side view showing an assembled structure of the second embodiment.
Figure 16:
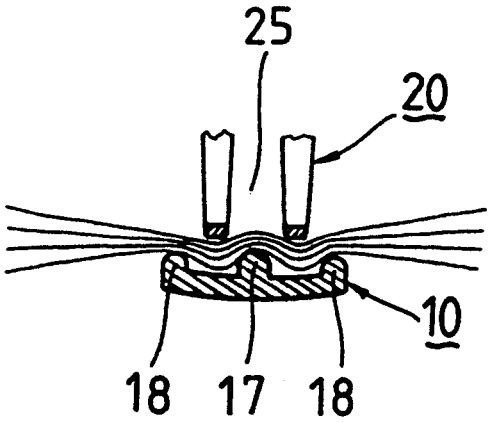
FIG. 16 is a sectional view showing a hair bundle being fastened by a first and a second member in accordance with the second embodiment of the present invention.

FIGS. 15 and 16 respectively show an assembled structure of a barrette and the gripping condition of the second embodiment of the present invention. FIG. 16 indicates the central protrudent flange 17 that is higher than the lateral protrudent flanges 18 and incorporates with the elongate slot 25 on the second member 20 thereof so that the hair bundle is effectively fastened in a waved style.

Referring to FIG. 17, shows a third embodiment of a barrette structure wherein a separate structure of a second member 10 is provided. This second member differs from the prior in the manner of manufacture a movable elongate elastic plate 30 instead of the integrally formed a two, oppositely formed S shapes equivalent thereof. The elongate elastic plate 30 is also a roughly figure "8" shaped having at one end farmed a third hinge ring 31 and the other end an engageable rod 32*a*. The slightly arcuate rectangular body of the second member 20 is also modified, in corporated with by dividing the second hinge ring 21 thereof to form a receiving space thereinbetween for the insertion of the third hinge ring 31 therein when assembling, and adding a semicircular plate 27 in addition of a holder plate 28 at the under side of the other end thereon. So that the engageable rod 32 of the elongate elastic plate 30 would be releasably held therein. FIG. 18 and 18A show a assembly procedure for the separated structure of the second member in accordance with the third embodiment.

Figure 19:
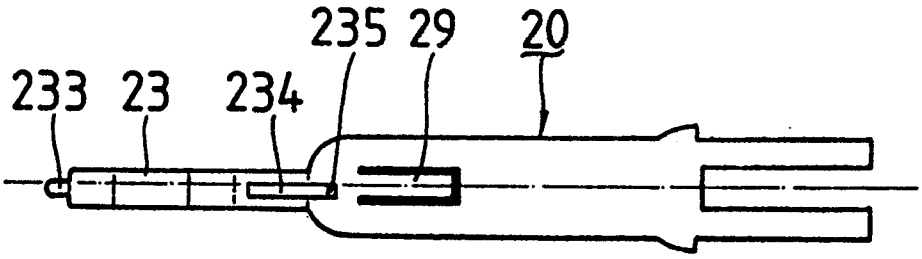
FIG. 19 is a top view showing a flattened structure of a second member of a barrette in accordance with a fourth embodiment of the present invention.
Figure 20:
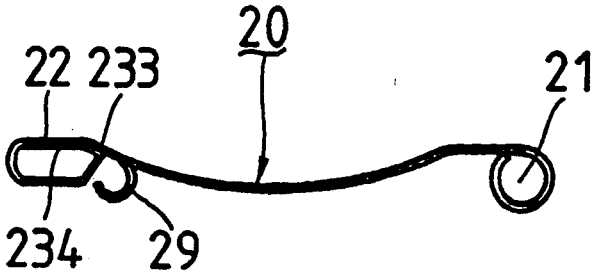
FIG. 20 is a side view showing a bent over structure of a second member in accordance with the fourth member.
Figure 21:
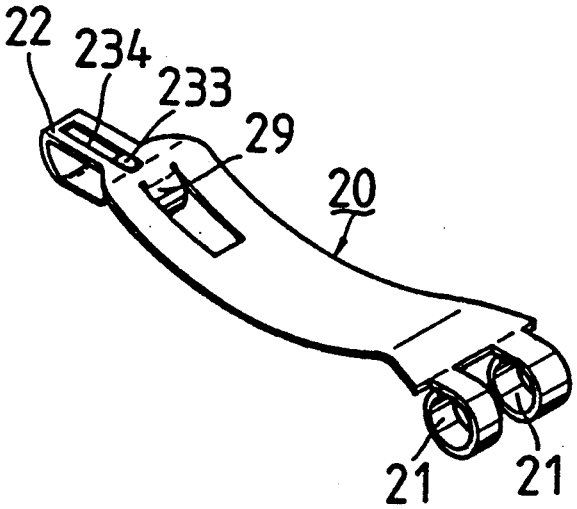
FIG. 21 is a perspective view showing a second member of a barrette in accordance with the fourth embodiment of FIG. 20.

With reference to FIGS. 19 to 21, shows a fourth and final embodiment of a barrette structure wherein the separate structure of the second member 20 of the third embodiment has been further modified. FIG. 19 shows a flattened structure of an elongate rectangular body of the second member 20 in which comprises at one end a pair of narrower elongate rectangular plates parallel extended therefrom which are bent into a pair of the second hinge rings 21 (as shown in FIG. 20), a biased elongate rectangular plate extended from the other end thereof which is folded over to form a roughly rectangular hasp 22, a small tab 233 on the top thereof which is inserted, via the under side of the second member 20 into a small rectangular recess 235 and folded forwards over upon the upper surface thereon, a cutted off rectangular piece adjacent the fore end of the second member 20 which is bent to a semicircular holder means projected downward on the under side therefrom abutting the rectangular hasp 22, and an elongate recess 234 adjacent the small rectangular recess 235 which is formed for the reinforcement purpose. The inward wall of the rectangular hasp 22 is sloped off in corporating with the holder 29 so as to form a small slit thereinbetween. A circular ring 32*b* with a small slit instead of the engageable rod 32*a* is bent on the corresponding end of the elongate elastic plate 30 of the third embodiment. FIG. 21 is a perspective view to show a complete structure of the second member 20 in accordance with the fourth embodiment of the present invention.

Figure 22:
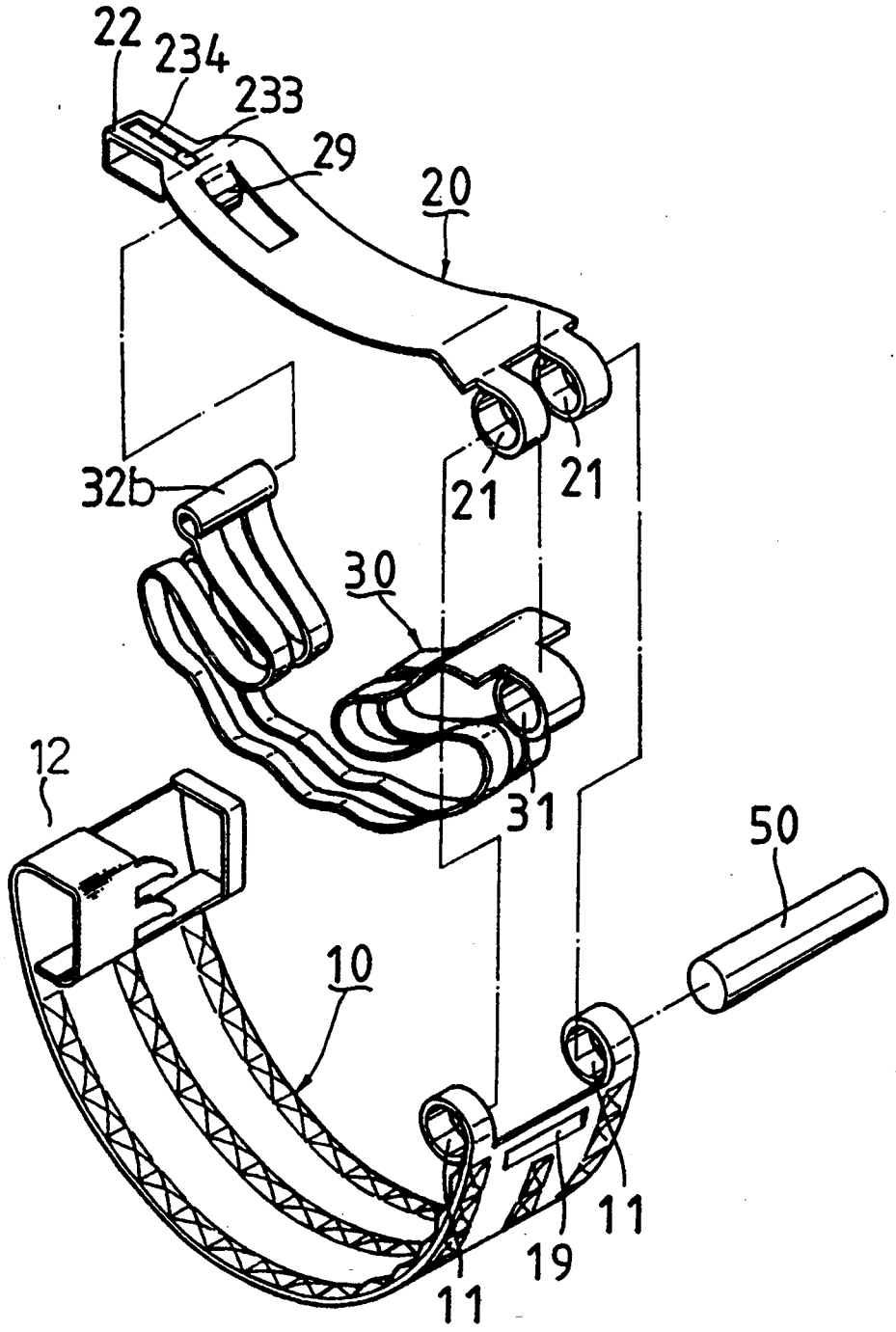
FIG. 22 is an exploded perspective view showing a complete structure of a barrette in accordance with the fourth embodiment of the present invention.

Referring to FIG. 22, an exploded perspective view shows a complete barrette structure according to the fourth embodiment in which the first member 10 is generally unchanged as it is in the first embodiment except a reinforcement recess 19 formed adjacent to the hinge rings 11. When assembling, releasably engage the circular ring 32*b* of the elongate elastic plate 30 via the slit with the semicircular holder means 29 on the body of the second member 20 therein and align with the hinge rings 11, 21 and 31 on attaching ends thereof prior to pivotally secure by the retaining pin 50, then, press the rectangular hasp 22 into the locking means 12 so as to releasably engage therein.

Generally, the barrette structure of the present invention provides a stepped locking means with sliding engagement and disengagement. A multiple elastic region formed therein enables this barrette serving for different hair bundles in varied styles.

Note that the specification relating to the above embodiments should be construed as to be exemplary rather than as limitative of the present invention, with many variations and modifications being readily attainable by a person of average skill in the art without departing from the spirit or the scope thereof as defined by the apended claims and their legal equivalents.

I claim:

1. A barrette for clipping hair comprising:

first and second arcuate elongate members pivotally connected with each other on corresponding end portions thereof, said first member having greater curvature than said second member;

said first member comprising, at one end, a pair of laterally formed first hinge rings and at the other end a generally rectangular locking means and three rows of generally pyramid shaped projections; said three rows of projections extending parallel to each and being positioned on an inward periphery of the first member along a longitudinal direction thereof;

said locking means comprising an off-center rectangular receiving space abutting one lateral side of said first member and having a pair of superposed catch means which are parallel to each other; said catch means being perpendicular to an inner wall of said receiving space and terminating at a position to form a flexible space; said catch means each having an inclined arcuate upper surface and a tapered end;

said second member comprising, at one end, a second hinge ring and at the other end a generally rectangular hasp and a two, oppositely formed "S" shapes which are connected at one end to form a closed elongate, elastic plate, said closed elongate, elastic plate being located between the two ends of said second member and extending downward from an underside of said second member; said generally rectangular hasp having a hollow interior and lateral openings defining a pair of vertically superposed tabs which form inclined arcuate upper surface and a partially arcuate underside; said closed elongate, elastic plate having a centrally formed elongate slot along a longitudinal direction and a waved bottom portion, said waved bottom portion having two rows of smaller pyramid shaped projections formed thereon.

2. A barrette according to claim 1, wherein said second member includes three rows of elongate protruding means, said three rows of elongate protruding means having a central row, said central row being of greater height than the other two rows.

3. A barrette according to claim 1, wherein said second member comprises a slightly arcuate elongate body and a movable, elastic, elongate plate pivotally attached to each other on corresponding ends;

said elongate body comprising, at one end, a pair of laterally formed second hinge rings and at the other end a generally rectangular locking means and a semicircular holder projecting from an underside thereof;

movable, elastic, elongate plate being formed of two, oppositely formed "S" shapes which are connected at one end, said closed,elongate, elastic plate having a third hinge ring formed at one end and an engageable rod at the other end thereof.

4. A barrette according to claim 3, wherein said elongate body comprises, at one end, a pair of laterally bent over second hinge rings and at the other end a folded over rectangular hasp with a rectangular reinforcment recess on an upper wall thereof and a semicircular holder projecting downwardly from an underside thereof and abutting said hasp;

said movable, elastic, elongate plate is formed of two, oppositely formed "S" shapes which are connected at one end; said plate having a centrally formed slot along a longitudinal direction and two rows of smaller pyramid shaped projections extending along a waved bottom portion, said plate further comprising a third hinge ring being bent over at one end and a circular ring with a slit therein being bent over at the other end for releasably engaging with said semicircular holder.

* * * * *